United States Patent [19]

Miyahara et al.

[11] Patent Number: 4,472,203

[45] Date of Patent: Sep. 18, 1984

[54] METHOD FOR THE SEPARATION OF GLUCOSE AND FRUCTOSE

[75] Inventors: Akimitsu Miyahara, Tokyo; Sigeo Sakai, Niiza; Fumihiko Matsuda, Tokorozawa; Hiroji Ushikubo, Ageo; Kuniaki Kawano, Matsudo, all of Japan

[73] Assignee: Japan Organo Co., Ltd., Tokyo, Japan

[21] Appl. No.: 399,280

[22] Filed: Jul. 19, 1982

Related U.S. Application Data

[63] Continuation of Ser. No. 185,139, Sep. 8, 1980, abandoned.

[51] Int. Cl.[3] ..... C13D 3/12

[52] U.S. Cl. ..... 127/46.2; 127/46.3; 210/672; 210/677

[58] Field of Search ..... 127/46.2, 46.3; 210/656, 672, 677

[56] References Cited

U.S. PATENT DOCUMENTS

| | | | |
|---|---|---|---|
| 3,044,904 | 7/1962 | Serbia | 127/46.2 |
| 3,416,961 | 12/1968 | Mountfort et al. | 127/46.2 |
| 4,022,637 | 5/1977 | Sutthoff et al. | 127/46.2 |

FOREIGN PATENT DOCUMENTS

| | | |
|---|---|---|
| 4524807 | 8/1970 | Japan . |
| 4605782 | 2/1971 | Japan . |
| 51101140 | 9/1976 | Japan . |
| 5326336 | 3/1978 | Japan . |
| 5388335 | 8/1978 | Japan . |
| 1083500 | 9/1967 | United Kingdom . |

*Primary Examiner*—Kenneth M. Schor

*Attorney, Agent, or Firm*—Armstrong, Nikaido, Marmelstein & Kubovcik

[57] ABSTRACT

Disclosed herein is a method for the separation of a mixed glucose-fructose solution into glucose and fructose by using a strongly acidic cation exchange resin of alkaline earth metal type and, more particularly, such method for the separation of glucose and fructose wherein said mixed glucose-fructose solution and water are supplied to and circulated through a bed of said cation exchange resin at least twice for increasing the distance between a zone of adsorption for glucose and a zone of adsorption for fructose that are formed in this way in the bed and, after such preliminary procedure, the glucose fraction and the fructose fraction of the effluent liquid are removed spotwise from the system while the remaining effluent fractions are again circulated in the order of efflux; at this time, the mixed glucose-fructose solution is injected spotwise into a portion of the liquid flow where the fructose content ratio is approximately equal to or slightly lower than that of the mixed glucose-fructose liquid, and water is injected into a portion of the liquid flow corresponding to the dilute fructose liquid, by way of such separation procedure, the latter step being carried out several times on end for sequentially taking out liquid glucose and fructose.

4 Claims, 7 Drawing Figures

METHOD FOR THE SEPARATION OF GLUCOSE AND FRUCTOSE

This is a continuation of application Ser. No. 185,139, filed Sept. 8, 1980, abandoned.

BACKGROUND OF THE INVENTION

1. Field of the Invention

This invention relates to a method for the separation of a mixed solution of glucose and fructose into liquid glucose and liquid fructose, by using a fixed bed of a strongly acidic cation exchange resin of the alkaline earth metal type, and has it for its object to obtain liquid glucose and liquid fructose of higher purity with a higher yield.

2. Description of the Prior Art

So far, for separating a mixed sugar solution of glucose and fructose into glucose and fructose, it is known to use a cation exchange resin in the calcium form for column chromatographic separation of the mixed solution, as taught by the U.S. Pat. No. 3,044,904, Japanese Patent Publication No. 24807 of 1970 and Austrian Pat. No. 1,083,500. It is also known to separate fructose and glucose from saccharose or a saccharose containing invert sugar, as taught by the Japanese Patent Publication No. 5782 of 1971 and Japanese Provisional Publication No. 101140 of 1976, or to separate fructose and glucose from an isomerized sugar by using a pseudo moving bed, as taught by the Japanese Provisional Publication Nos. 26336 and 88335 of 1978.

These known methods have practically many difficulties and are not useful for industrial application.

The method of the U.S. Pat. No. 3,044,904 teaches a basic principle of separating a mixed solution of fructose and glucose and difficulties are involved in industrial application thereof. The method of the Japanese Patent Publication No. 24807 of 1970 is an improvement over the method of the U.S. Pat. No. 3,044,904, however, it does not lend itself to obtainment of liquid glucose and fructose of high purity with a high yield. In the method of the Japanese Patent Publication No. 5782 of 1971, the starting sugar solution is passed through a cation exchange resin, a part of which is allowed to remain as H type to effect inversion of saccharose contained in the sugar solution and simultaneous adsorption of foreign salts. This known method is again not advantageous for industrial application because an extremely long column is required for elevating the separation efficiency. The method of the Japanese Provisional Patent Publication No. 101140 of 1976 is an improvement over this known method, however, it uses a number of columns and is highly complex in operation and is not practical for industrial application. A pseudo moving bed is used in both the Japanese Provisional Patent Publication No. 26336 of 1978 in which zeolite is used as adsorbing agent and the Japanese Provisional Patent Publication No. 88355 of 1978 in which a cation exchange resin is used as such agent. Both of these methods use a large number of columns and are highly complex in operation and therefore many difficulties are met in industrial application.

Fixed beds are simpler and more reliable than pseudo moving beds in the case of application as industrial devices, however, the method using a fixed bed as taught by the Japanese Patent Publication No. 24807 of 1970 does not lend itself to obtainment of liquid fructose and liquid glucose of higher purity with a high yield, as described above.

In more detail, according to the method of this Patent Publication No. 24807 of 1970, in which a fixed bed of the strongly acidic cation exchange resin of the alkaline earth metal type is used for separating a starting mixed solution of glucose and fructose (hereafter referred to simply as starting solution or liquid) into liquid glucose and liquid fructose, the starting liquid and water are sequentially supplied to the fixed bed so that an artifice of chromatographic separation is employed to effect the desired separation.

Thus, as the starting liquid and water are sequentially supplied to the fixed bed, glucose and fructose are separated chromatographically from each other, and the effluent liquid is separated to some degree into a glucose fraction G and a fructose fraction F, as shown in FIG. 2. This effluent liquid is divided into a dilute glucose solution "a", a glucose solution "b", a mixed solution enriched in glucose "c", a mixed solution enriched in fructose "d", a fructose solution "e", a dilute fructose solution "f" and a dilute solution "g". The dilute solutions "a" and "g" are received in the tanks for dilute solutions and are removed from the system, the glucose solution "b" and the fructose solution "e" are received in their respective tanks and removed as ultimate products from the system, while the mixed solutions "c", "d" and the dilute fructose solution "f" are received in their respective tanks. Then, the mixed solution "c", the starting solution, the mixed solution "d", the dilute fructose solution "f" and water are sequentially supplied to the fixed bed, and the effluent liquid is again received in the respective tanks as shown in FIG. 2. The above procedure is carried out several times for obtaining liquid glucose and liquid fructose.

With this known method, however, adsorption zones for glucose and fructose are located close to each other and hence liquid glucose and liquid fructose cannot be obtained with a high yield.

SUMMARY OF THE INVENTION

This invention envisages to obviate the above drawback inherent in the conventional methods which make use of fixed beds of the strongly acidic cation exchange resin of the alkaline earth metal type and to obtain liquid glucose and fructose of higher purity with a good yield. To this end, the present invention resides in the method for the separation of the starting liquid into liquid glucose and liquid fructose by passing the starting liquid as descending or ascending current through the fixed bed of the strongly acidic cation exchange resin of the alkaline earth metal type, such method being characterized in that, as a preliminary procedure, a predetermined amount of the starting mixed glucose and fructose solution and a predetermined amount of water are sequentially supplied to said fixed bed and an effluent liquid from said fixed bed is recycled at least twice to said bed for increasing the distance between a zone to which liquid glucose is preferentially adsorbed and a zone to which liquid fructose is preferentially adsorbed, in the course of transit through said fixed bed; during such recycling of the preliminary step, the effluent liquid is allowed to flow out of the fixed bed in the order of a dilute glucose fraction, a glucose fraction, a mixed glucose-fructose fraction, a fructose fraction and a dilute fructose fraction and thus with a chromatographic distribution of concentration of the respective fractions; after such recycling, as the separation procedure from among these fractions delivered from the bed, a predetermined amount of the glucose fraction is removed, a predetermined amount of the fructose fraction is removed spotwise from the system, the remaining liquids being recycled in the order of efflux; at this time, a predetermined amount of the starting liquid is injected spotwise into a portion of the recycled liquid where the fructose content ratio is approximately equal to or slightly lower than the fructose content ratio of the starting liquid and, after such injection of the starting liquid, a predetermined amount of water is injected spotwise into the recycle liquid, so that the sum of said predetermined amounts of said starting liquid and water to be thus injected may be equal to the sum of said predetermined amounts of said liquid fructose and glucose to be removed from the system; said separation procedure being repeated several times for sequential removal of the liquid glucose and fructose.

BRIEF DESCRIPTION OF THE DRAWINGS

In the drawings showing a preferred embodiment of the present invention.

DETAILED DESCRIPTION OF PREFERRED EMBODIMENTS

A preferred embodiment of the present invention will be described below by referring to the accompanying drawings.

Figure 1:
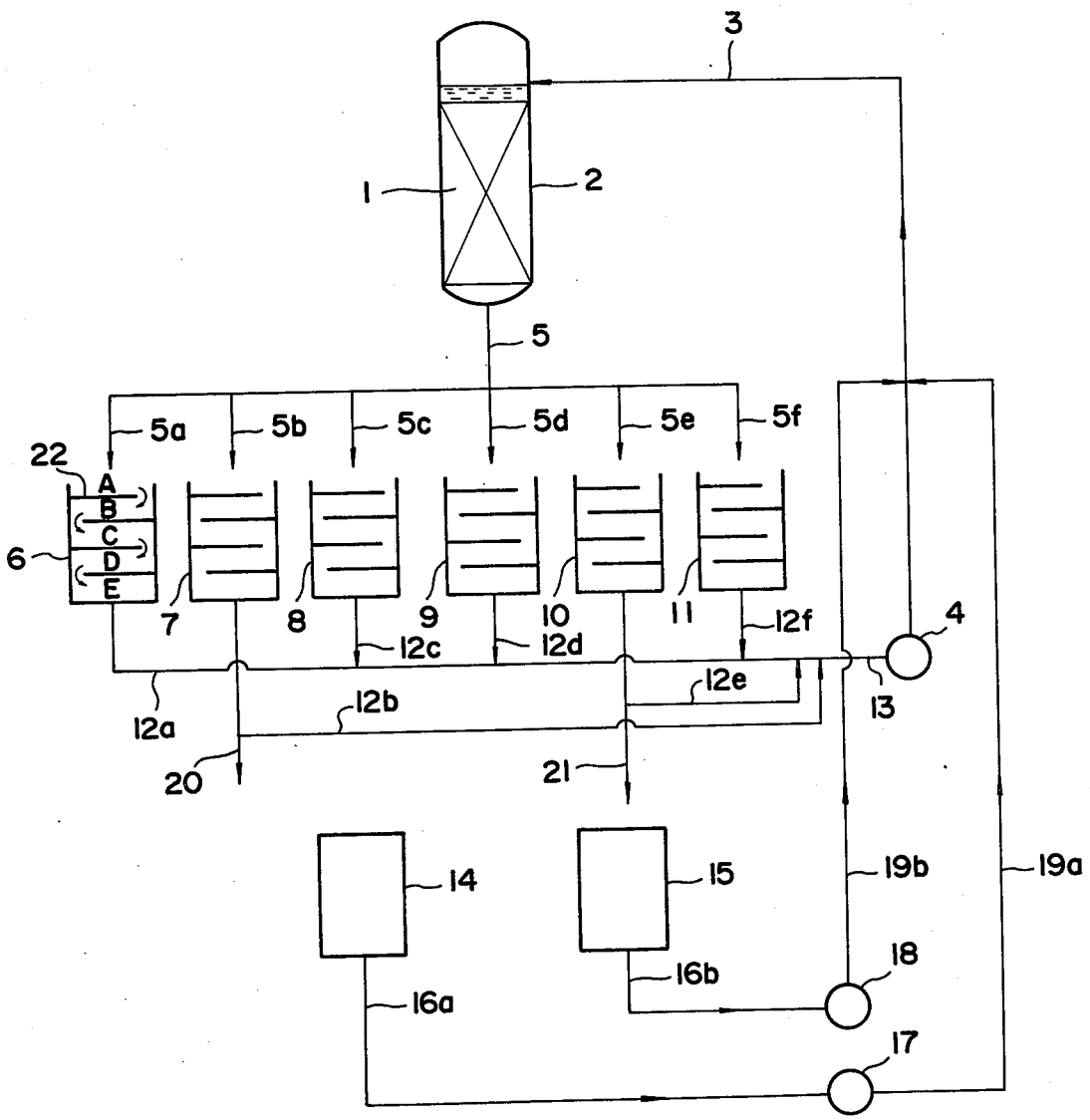
FIG. 1 is a flow chart illustrative of the present method for the separation of glucose and fructose.

FIG. 1 is a flow chart showing a device for the separation for glucose and fructose, wherein a strongly acidic cation exchange resin "1" of the alkaline earth metal type is packed in an adsorption column "2", the upper end of which communicates with one end of an influx pipe "3", the other end of the pipe "3" communicating in turn with a pump "4". The lower end of the column "2" communicates with one end of an efflux pipe "5", the other end of which communicates in turn with efflux branch pipes "5*a*", "5*b*", "5*c*", "5*d*", "5*e*" and "5*f*". There are provided a tank "6" for dilute glucose, a tank "7" for glucose liquid, a tank "8" for a mixed liquid enriched with respect to glucose, a tank "9" for a mixed liquid enriched with respect to fructose, a tank "10" for fructose liquid and a tank "11" for a dilute fructose liquid, each of these tanks having weirs 22. The effluent liquids from the branch pipes "5*a*", "5*b*", "5*c*", "5*d*", "5*e*" and "5*f*" flow into tanks "6", "7", "8", "9", "10" and "11" respectively. Suction pipes "12*a*", "12*b*", "12*c*", "12*d*", "12*e*" and "12*f*" communicate at one end to lower portions of the tanks "6", "7", "8", "9", "10" and "11", respectively, the other ends of these suction pipes being connected to a common suction pipe "13" communicating in turn with a pump "4". There are also provided a tank "14" for starting solution and a water tank "15". One end of an influent pipe "16*a*" is connected to the lower portion of the tank "14", while one end of another influent pipe "16*b*" is connected to the lower portion of the tank "15", the other ends of the pipes "16*a*", "16*b*" being connected to pumps "17", "18" respectively. One ends of discharge pipes "19*a*", "19*b*" are connected to the pumps "17", "18", the other ends of the pipes "19*a*", "19*b*" being connected respectively to some intermediate portion of the influx pipe "3". A glucose liquid or fraction take-out tube "20" is branched from the suction pipe "12*b*", and a fructose liquid or fraction take-out tube "21" is branched from the suction pipe "12*e*".

According to the present invention, in separating glucose and fructose fractions from the starting solution, by using the above-mentioned separating device, a predetermined amount of the starting liquid and also a predetermined amount of water are sequentially supplied to the column and the effluent liquid is again supplied or recycled at least twice to the column as it is discharged therefrom, as a preliminary procedure.

In more detail, a predetermined amount of the starting liquid is supplied by pump "17" from the tank "14" into the upper portion of the adsorption column "2" in which a water layer has been formed on top of the bed or layer of the cation exchange resin "1". Upon completion of supply of this amount of the starting liquid, a predetermined amount of water is supplied from the tank "15" by means of pump "18". With influx of the starting liquid and water, the effluent liquid is discharged simultaneously from the lower portion of the column "2". The effluent liquid is separated to some degree into a glucose fraction "G" and a fructose fraction "F", and is delivered into the tanks "6", "7", "8", "9", "10" and "11" by means of branch pipes "5*a*", "5*b*", "5*c*", "5*d*", "5*e*" and "5*f*", in the order of efflux of the liquid, respectively. These separate liquid fractions are again supplied or recycled to the adsorption column "2" in the order of efflux of the liquid.

In greater detail, the dilute glucose liquid in the tank "6" is supplied first to the top of the column "2" through pipe "12*a*" by means of pump 4.

Then, the solutions in the tanks "7", "8", "9", "10" and "11" are supplied in this order to the top of the column "2" through pipes "12*b*", "12*c*", "12*d*", "12*e*" and "12*f*", respectively, and the effluent liquid is received again in the tanks "6, "7", "8", "9", "10" and "11" in the order of efflux thereof. By repetition of the operations described in the foregoing, the concentration curve for the glucose fraction "G" is defined more and more sharply from that of the fructose fraction "F", by degrees, as seen from FIGS. 3 and 4 which stand for the distribution of concentration in the effluent liquids for the second and third cycles, respectively. This indicates that the distance between the zone to which glucose has been adsorbed and the equally moving zone to which fructose has been adsorbed may be increased by degrees in the course of the above cyclical operations.

According to the present invention, by virtue of the preliminary step consisting in the circulation of the effluent liquid for increasing the distance between the zone in the bed to which glucose has been adsorbed and that to which fructose has been adsorbed, liquid glucose and liquid fructose of higher purity can be obtained at higher yield in the next following separating procedure.

Thus, liquid glucose and liquid fructose can be obtained from the third cycle effluent liquid by virtue of the following separation procedure.

Figure 4:
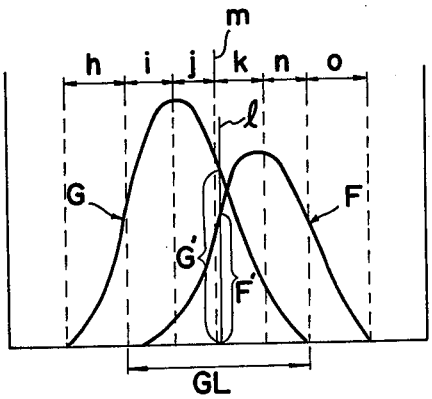

In the third cycle of operation, as shown in FIG. 4, the dilute glucose solution "h", the first effluent, is supplied to tank "6"; the next following glucose solution "i" of higher purity is received in tank "7"; the next following mixed solution "j" rich in glucose is received in tank "8"; the next following mixed solution "k" rich in fructose is received in tank "9"; the next following fructose solution "n" of higher purity is received in tank "10"; and the dilute fructose solution "o", the last efflux, is received in tank "11". The glucose solution "i" of higher purity contained in the tank "7" is removed out of the system by means of a take-out pipe "20", and the fructose solution "n" of higher purity in the tank "10" is also removed from the system by a take-out pipe "21". The remaining effluent liquid portions are recycled to the column by pump "4" in the order of efflux thereof. At this time, however, predetermined amounts of the starting liquid and water are injected into specific portions of the recycle flow of liquid spotwise.

During circulation for the separation procedure, the effluent in the tank "6" and the effluent in the tank "8" are sequentially fed by pump "4" into the column "2" and a predetermined amount of the starting liquid is supplied from the tank "14" by pump "17" into the column. Then, the effluent in the tank "9" and the effluent in the tank "11" are fed sequentially into the column "2", and a predetermined amount of water is supplied into the column "2" from tank "15" by means of pump "18". The effluent liquid from the column "2" is again divided into portions "h", "i", "j", "k", "n" and "o" which are received in the tanks "6", "7", "8", "9", "10" and "11", respectively. Liquid glucose and liquid fructose are taken out by the separation procedure in which the glucose portion "i" and the fructose portion "n" are removed and the starting liquid and water are injected into the column, as described above.

According to the present invention, liquid glucose and fructose can be obtained sequentially with high yield by means of the preliminary procedure (which is carried out first) and subsequent separation procedure both of which are carried out repeatedly. At this time it is required that, in the preliminary procedure, the concentration curve for effluent glucose and that for effluent fructose are not disturbed and that, in the separation procedure, good repeatability be afforded to the distribution of concentration for the glucose fraction and that of the fructose fraction, as shown typically in FIG. 4.

According to the invention, this requirement is attained by three technical means as described below.

First of all, in circulating the effluent liquid from the column "2" in the preliminary procedure and the separation procedure, the effluent liquid must be reintroduced into the column "2" in the order of efflux thereof. In order for the effluent liquid to be reintroduced in the course of circulation into the column "2" in the order of efflux thereof, as many small size tanks may be provided as possible and operated in such a manner that the effluent liquid is received in these tanks and discharged therefrom into the column upon completion of reception and in the order that the liquid is received in these tanks. This method is however inconvenient for industrial application because a number of tanks are required to install and to be switched ever so often. According to the present invention the same effect is obtained by provision of a plurality of weirs "22" in each of the tanks "6", "7", "8", "9", "10" and "11". In the case of the tank "6", for example, four spaced weirs "22" are provided in the tank "6" so that alternate ends of these weirs are detached from the inner wall surface of the tank "6" for dividing the inner space thereof into five sections "A", "B", "C", "D" and "E" as viewd from above. In this way, the liquid is introduced from the top and allowed to stay in the sections "E", "D", "C", "B" and "A" in the order of influx so that the liquid can be taken out from the bottom in the order of influx.

Thus, these four weirs "22" provide for a separation capacity owned by five tanks. In FIG. 1 there are six tanks each having four weirs and hence the effect is that of thirty tanks.

Figure 5:
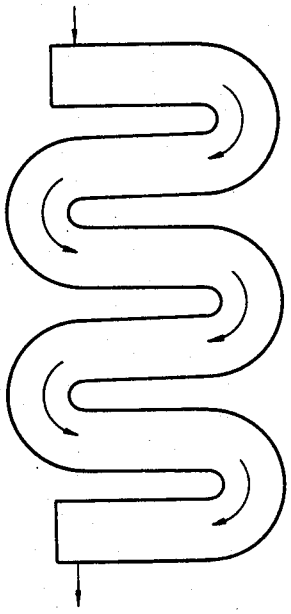
FIGS. 5 and 6 show only schematically modified embodiments of liquid tanks.
Figure 6:
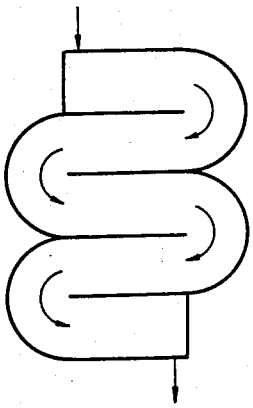

As an alternative, a spiral tube of a larger diameter may be provided as shown in FIGS. 5 and 6 for realizing the same effect. Any of the arrangements shown in FIGS. 1, 5 or 6 may be used for supplying the liquid into the adsorption column in the order of influx for both the preliminary process and the next following separating process.

Second, injection of the starting liquid in the separating procedure should be into the glucose-fructose mixture portion of the recycle liquid where the fructose content ratio is slightly smaller than the fructose content ratio of the starting liquid.

The glucose-fructose mixture portion in the recycle liquid is indicated as GL in FIG. 4. Injection of the starting liquid should be at a point where the fructose content ratio of the recycle liquid is about equal to or slightly smaller than that of the starting liquid. Thus, assuming that the ratio of glucose concentration G' to fructose concentration F' at line "1" in FIG. 4 is equal to the ratio of glucose concentration to fructose concentration in the starting liquid, the zone close to line "1" or the zone close to or at line "m" which is slightly to the left of line "1" need be selected as reception switching point from the tank "8" to the tank "9".

Third, the sum of the injected amounts of the starting liquid and water in the course of the separating procedure should be equal to the sum of liquid glucose and fructose to be taken out of the system.

The glucose and fructose fractions of higher purity may be obtained only by resorting to the three technical means described above.

Figure 2:
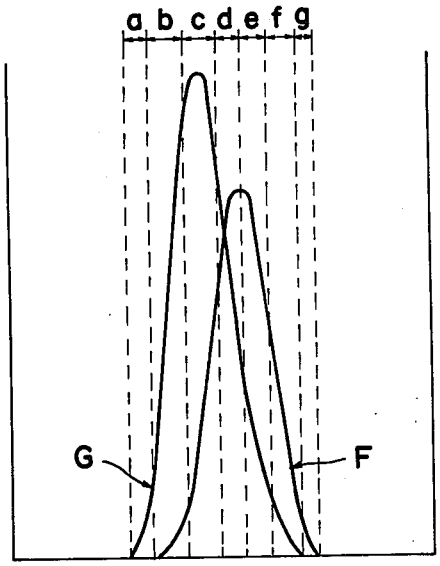
FIGS. 2, 3 and 4 show the distribution of concentration for glucose and fructose of the effluent liquid with the concentration for the two sugars and the amount of effluent liquids being plotted on the abscissa and ordinate, respectively, wherein FIG. 2 stands for such distribution for the first cycle, FIG. 3 stands for the distribution for the second cycle and FIG. 4 stands for such distribution for the third cycle.
Figure 3:
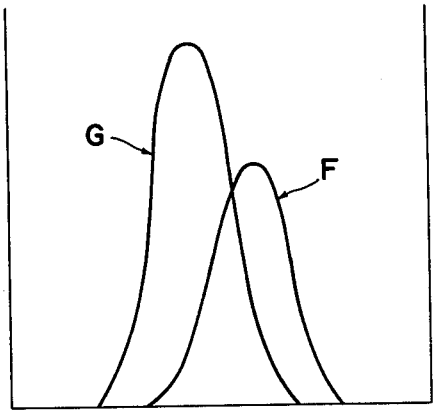

In the circulation for the preliminary procedure, concentration curves for the two sugars are changed as shown in FIGS. 2, 3 and 4 with progress of circulation and the glucose fraction "G" is separated more clearly from the fructose fraction "F". However, such separation of the two sugars is accompanied by reduction in concentration of the two sugars in the effluent liquid. Hence, a large number of times of circulation is not desirable and three to five times of such circulation is preferred.

Next, an explanation will be made of the amounts of influx of the starting liquid and water in the preliminary procedure and the water balance in the separating procedure.

The amount of influx of the starting liquid in the preliminary process is preferably 0.2 to 0.7 liter per liter of cation exchange resin and, the more the influx of the liquid in this range, the higher will be the concentrations of the two sugar liquids to be obtained in the following separation procedure. An amount in excess of 0.7 liter per each liter of resin is not desirable because of the lowered separation efficiency. The amount of influx of water should be approximately proportional to the amount of starting liquid and in the range of 0.2 to 0.8 liter per liter of cation exchange resin. An amount in excess of the above value is not desirable because the two sugars may thereby be diluted excessively.

Referring to the water balance in the separation procedure, in FIG. 4, the portion "h" to be received in the tank "6" be in the range of 0.05 to 0.15 liter and preferably 0.1 liter per each liter of cation exchange regin; the portion "i" to be received in the tank "7" be in the range of 0.2 to 0.3 liter per liter of cation exchange resin; the portion "j" to be received in the tank "8" be in the range of 0.15 to 0.4 liter per liter and preferably 0.3 liter per liter of cation exchange resin; the portion "k" to be received in the tank "9" be in the range of 0.1 to 0.3 liter and preferably 0.2 liter per liter of cation exchange resin; portion "n" to be received in the tank "10" be in the range of 0.1 to 0.2 liter and preferably 0.15 liter per liter of cation exchange resin; and the portion "o" to be received in the tank 11 be in the range of 0.05 to 0.15 liter and preferably 0.1 liter per each liter of cation exchange resin.

The starting liquid should preferably be injected in an amount of 0.1 to 0.3 liter and preferably 0.15 liter per liter of cation exchange resin and water should be injected in an amount of 0.15 to 0.3 liter and preferably 0.2 liter per liter of cation exchange resin.

Although six tanks are used in the embodiment of FIG. 1, the tanks "6" or "11" may be omitted, if there is no specific need for elevating the concentrations of liquid glucose or fructose to be discharged from the system. However, the tanks "7", "8", "9" and "10" are essential and can not be omitted.

The strongly acidic cation exchange resin to be used in the present invention should be preferably porous and the resin with finer particle size is preferred for increased separation capacity. However, the resin with too fine particle size may give rise to increased pressure loss with resulting hindrance to liquid flow or channeling. Hence, the mesh size of 40 to 200 in the wetted state is most preferred. According to the present invention, the cation exchange resin is used with alkaline earth metals adsorbed thereto and is usually employed in the calcium form through regeneration with calcium chloride.

An isomerized glucose liquid is generally employed for a starting sugar solution with the concentration thereof in the sugar solution being 35 to 60%. Although an ambient temperature has more superior separation capacity, a temperature of 60° to 80° C. is preferred for reducing pressure losses during circulation of the sugar solution and prevention of microbial contamination.

The fructose fraction obtained by the present process is separated as ultimate product, while the glucose fragment is recycled to the isomerization process.

EXAMPLE

The strongly acidic cation exchange resin XT-1022E of 850 ml (manufactured by TOKYO ORGANIC CHEMICAL INDUSTRIES, LTD.) with particle size of 50 to 70 mesh is filled into a column 21 mm across and 2,110 mm high and a 1N solution of calcium chloride was supplied thereto in an amount of 3 liters per liter of resin for completely regenerating the resin into the calcium form.

Figure 7:
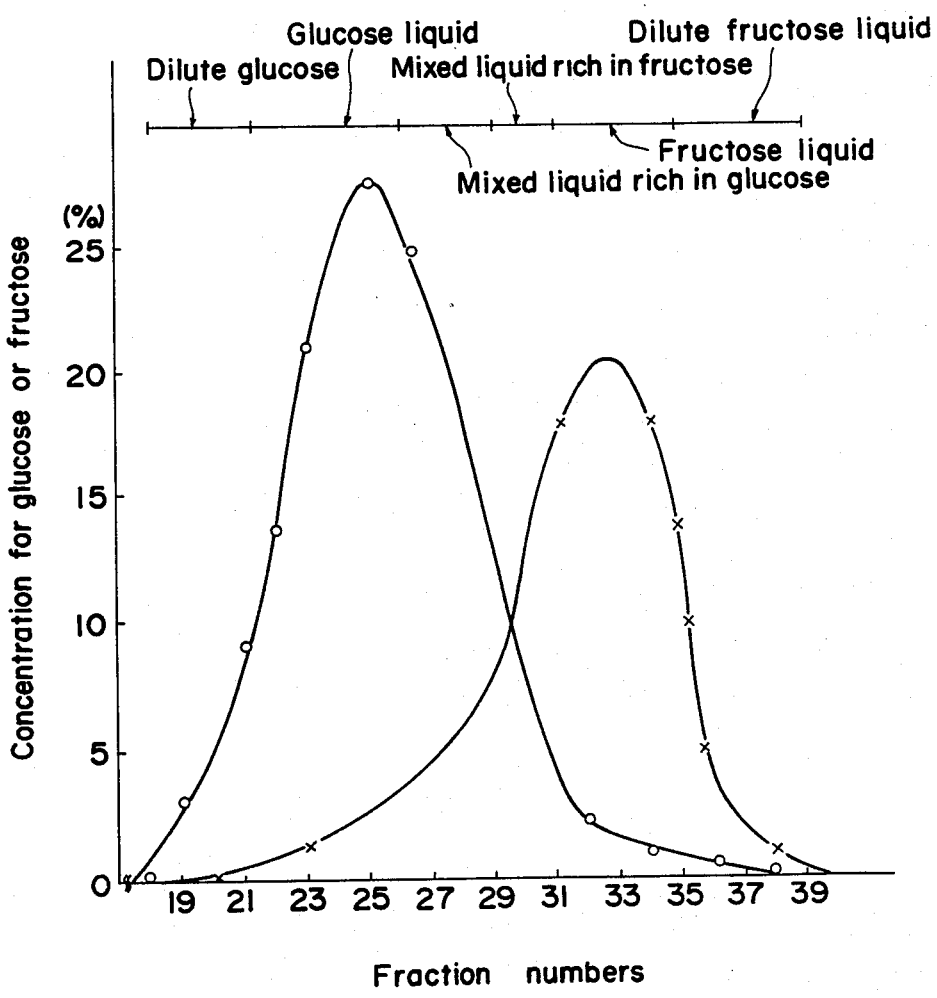
FIG. 7 is a detailed diagram showing the distribution of concentration for glucose and fructose of the effluent liquid in the third cycle wherein the distribution of concentrations for the two sugars are plotted on the ordinate and the fraction numbers are plotted on the abscissa.

Then 255 ml of a starting sugar solution (starting concentration, 45%; starting glucose contents, 58%; starting fructose concentration, 42%) was supplied to this calcium form resin as descending current at 60° C. and SV of 0.4. In addition water was supplied in an amount of 340 ml. The effluent liquid was separated into fractions of 0.05 liter per liter of calcium form resin and taken out, these fractions being recycled to the top of the column in the order that they were taken out previously from the column. The procedure was repeated thrice. FIG. 7 shows the state of separation of the effluent liquid into glucose and fructose, the effluent liquid being from the third cycle of operation. These fractions are identified as dilute glucose solution, glucose solution, mixed solution rich in glucose, mixed solution rich in fructose, fructose solution and a dilute fructose solution. The boundary line between the mixture solutions has been selected at a point where the fructose content ratio of the mixture is equal to 39%, which is slightly smaller than the fructose content ratio in the starting solution.

Then, 212.5 ml (49.8 g of glucose and 5.4 g of fructose) of the mixed solution enriched in glucose, comprised of five fraction, Nos. 21 to 26 shown in FIG. 7, and 170 ml (32.8 g of fructose and 3.1 g of glucose) of the mixed solution enriched in fructose, comprised of four fractions Nos. 31 to 35 shown also in FIG. 7 were removed from the system. 170 ml of the starting solution (53.2 g of glucose and 38.6 g of fructose) and 212.5 ml of water were supplied in place thereof for further circulation. Thus, injection was made in the order of dilute glucose solution, mixed solution enriched in glucose, starting solution, mixed solution enriched in fructose, dilute fructose solution and water, and the following cycles were carried out with removal of sugar solutions and injection of starting solution and water for each cycle for attaining the separation into liquid glucose and liquid fructose. Table 1 below shows the mean sugar composition for the liquid glucose and liquid fructose as taken out from the system.

TABLE 1

| | sugar concentration | glucose contents (%) | fructose contents (%) |
|---|---|---|---|
| liquid glucose fraction | 24.7 | 90.2 | 9.8 |
| liquid fructose fraction | 19.7 | 8.3 | 91.5 |

What is claimed is:

1. A method for separating glucose and fructose from a mixed solution containing the same, said method comprising:

(1) sequentially supplying the mixed solution and then water to a bed of strongly acidic cation exchange resin of the alkaline earth metal type;

(2)

(a) sequentially separating the efflux from the bed into at least the following fractions of effluent liquid:

(i) a dilute glucose solution;

(ii) a glucose solution;

(iii) a mixed glucose-fructose solution;

(iv) a fructose solution; and (v) a dilute fructose solution;

(b) recycling the effluent liquids to said bed in the order separated;

(c) repeating steps (a) and (b) at least two more times whereby the distance between a zone in the bed where glucose is preferentially absorbed and a zone where fructose is preferentially absorbed is increased;

(3) removing a predetermined amount of the glucose solution (ii) and the fructose solution (iv) from the effluent liquids obtained in sub-step (2c);

(4) recycling the remaining effluent liquids to said bed in the order separated from the efflux;

(5) injecting a predetermined amount of the mixed solution into the recycled effluent solution at a point in the recycling of step (4) where the fructose content ratio of fructose to glucose in the recycled effluent solutions is approximately equal to or slightly lower than the fructose to glucose ratio in said mixed solution, and injecting a predetermined amount of water into the recycled effluent solutions after the dilute fructose solution is recycled in step (4), the sum of said predetermined amount of said mixed solution and said water thus injected being equal to the sum of the predetermined amounts of the glucose solution (ii) and fructose solutions (iv) removed from the system.

2. The method as claimed in claim 1 wherein the tanks adapted to receive the effluent liquid from the bed of cation exchange resin are a dilute fructose liquid tank, a glucose liquid tank, a mixed glucose-fructose liquid tank, a fructose liquid tank and a dilute fructose liquid tank; and these tanks are adapted to allow the liquids received therein to descend stayingly and stationarily.

3. The method as claimed in claims 1 or 2 wherein the starting mixed solution of glucose and fructose is supplied as an ascending or descending current through the fixed bed of the strongly acidic cation exchange resin of the alkaline earth metal type.

4. The method as claimed in claim 1 or 2 wherein the strongly acidic cation exchange resin of the alkaline earth metal type is a strongly acidic cation exchange resin of calcium type.

* * * * *